US006263511B1

(12) United States Patent
Moretti

(10) Patent No.: US 6,263,511 B1
(45) Date of Patent: Jul. 24, 2001

(54) BREATHABLE GARMENT TO BE WORN TO IMPROVE THE COMFORT OF THE HUMAN BODY

(75) Inventor: Mario Polegato Moretti, Crocetta Del Montello (IT)

(73) Assignee: Nottington Holding B.V., Amsterdam (NL)

( * ) Notice: Subject to any disclaimer, the term of this patent is extended or adjusted under 35 U.S.C. 154(b) by 0 days.

(21) Appl. No.: 09/610,424

(22) Filed: Jul. 5, 2000

(30) Foreign Application Priority Data

Jul. 6, 1999 (IT) ..... PD99A0149

(51) Int. Cl.[7] ..... A41D 1/00; A41D 3/02

(52) U.S. Cl. ..... 2/97; 2/93; 2/DIG. 1; 2/410

(58) Field of Search ..... 2/97, 456, 457, 2/458, 2.11, 2.14, 410, DIG. 1, DIG. 5

(56) References Cited

U.S. PATENT DOCUMENTS

| | | | | |
|---|---|---|---|---|
| 385,306 | * | 6/1888 | Helwitz | 2/DIG. 1 |
| 825,851 | * | 7/1906 | MacKaskie | 2/DIG. 1 |
| 2,771,661 | * | 11/1956 | Foster | 2/DIG. 1 |
| 2,781,820 | * | 2/1957 | Rogers | 154/28 |
| 3,547,765 | * | 12/1970 | Snyder et al. | 161/189 |
| 3,710,395 | * | 1/1973 | Spano et al. | 2/78 |
| 3,783,451 | * | 1/1974 | Malin | 2/4 |
| 4,185,327 | * | 1/1980 | Markve | 2/2 |
| 4,270,227 | * | 6/1981 | Wolfe | 2/87 |
| 4,451,934 | * | 6/1984 | Gioello | 2/113 |
| 4,458,680 | * | 7/1984 | Childers et al. | 128/201.29 |
| 4,985,933 | * | 1/1991 | Lemoine | 2/84 |
| 5,005,216 | * | 4/1991 | Blackburn et al. | 2/DIG. 1 |
| 5,098,770 | * | 3/1992 | Paire | 428/198 |
| 5,515,543 | * | 5/1996 | Gioello | 2/69 |
| 5,774,902 | * | 7/1998 | Gehse | 2/458 |
| 6,032,300 | * | 3/2000 | Bainbridge et al. | 2/456 |
| 6,038,699 | * | 3/2000 | Han et al. | 2/69 |
| 6,070,274 | * | 6/2000 | Van Der Sleesen | 2/456 |
| 6,112,328 | * | 9/2000 | Spector | 2/69 |
| 6,125,645 | * | 10/2000 | Horn | 62/259.3 |

* cited by examiner

*Primary Examiner*—John J. Calvert
*Assistant Examiner*—Alissa L. Hoey
(74) *Attorney, Agent, or Firm*—Oblon, Spivak, McClelland, Maier & Neustadt, P.C.

(57) ABSTRACT

A breathable garment to be worn to improve the comfort of the human body, comprising a protective outer covering with an internal layer which extends over at least part of the extension of the outer covering and internally forms an interspace. The internal layer has, at least at the regions of the human body covered by the breathable garment where sweat forms more abundantly, holes for access to the interspace for the perspiration vapor. The internal layer and the outer covering have, in the top regions of the garment, holes for venting the vapor channeled by a stack effect inside the interspace, combined with a membrane for keeping out water, impurities or other matter.

35 Claims, 9 Drawing Sheets

BREATHABLE GARMENT TO BE WORN TO IMPROVE THE COMFORT OF THE HUMAN BODY

BACKGROUND OF THE INVENTION

The present invention relates to a breathable garment to be worn in order to improve the comfort of the human body.

It is known that people protect their body from atmospheric agents such as snow, rain, wind and particularly from the cold by wearing garments and footwear.

More specifically, it is noted that the human body is protected mainly by resorting to various "layers" of clothing, the first of which (underwear) is in direct contact with the body and is in turn covered by successive layers according to the outside temperature and to the environmental conditions.

Use of this kind of protection from the outside allows the body to easily adapt to temperature variations.

Depending on the environmental conditions in which a person find himself, it is in fact sufficient to add or remove one or more "layers" of clothing to feel comfortable and be at an optimum temperature.

For example, in the presence of rain it is commonplace to use a raincoat to protect oneself or to remove one's coat when arriving from outdoors into a heated environment.

The human body is inherently provided with "mechanisms" which help it adapt thermally in the environment in which it is placed.

In case of overheating, for example, the body reacts by increasing perspiration, which by evaporating allows a natural reduction of body temperature.

The heat produced by the human body, in addition to generating perspiration, is also transferred to the outside environment by radiation.

This heat, which is always present, warms the air contained between the body and the garment; said air, by rising, produces further overheating and discomfort, for example at the shoulders, which constitute regions of accumulation.

In order to obviate this drawback, it is necessary to produce or maximize a ventilation effect (air change) inside the garment regardless of the release of vapor, utilizing the differences in pressure that occur between the inside and the outside of the garment.

For example, with an outside temperature of 5° C. and a relative humidity of 50% and with the body at 25° C. and a relative humidity of 90%, the resulting pressure differential is approximately 24 millibar and is not a negligible factor.

If the water vapor is unable to escape from the protective covering that surrounds the human body (clothing), the humidity increases until the vapor condenses and returns to the liquid state of perspiration, thus soaking the clothes starting from the underwear that constitutes the first layer.

During this step of the process there is actually a further release of heat.

This unpleasant drawback can be remedied by removing the wet garment and replacing it with a dry one, for example immediately after completing a challenging mountain climb, but in this way one produces a sudden cooling of the body and risks pneumonia or colds.

While on the one hand the protection of the human body against the worst cold conditions is very effective, by using highly insulating materials, on the other hand one cannot avoid noting the inability to allow the body to perspire normally, ensuring the escape of the water vapor produced by perspiration.

Obviously, during the warm season the problem becomes more intense and forces many people to take several showers and continuously change clothing during the day.

Attempts have been made to remedy this drawback by using garments provided with special breathable properties, for example by resorting to a material known commercially by the trademark "Gore-Tex", owned by the company W.L. Gore & Associates, Inc.; however, in practice such garments are able to expel only part, often a very small part, of the vapor produced by perspiration and generated by the human body, especially at the regions that are richest in sweat glands, and in any case they are unable to ensure effective air change inside the garment.

Vapor permeation in fact occurs to a reduced extent, since inside the layer of the garment being worn the partial vapor pressure that forms is not sufficient to expel the sweat (in the vapor phase) outward.

In other cases, remedies have been attempted by providing more or less closeable openings in the garments at the regions where perspiration concentrates more, for example under the armpits, but even this does not ensure particular effects, since no actual air change is produced.

It should also be noted that even the attempt to increase effectiveness by providing a larger number of openings has failed to yield satisfactory results.

In practice, in fact, some parts of the garments always cling directly to the human body (particularly to the shoulders and chest), so that the water vapor generated by evaporation of body sweat remains trapped between the body and the regions of the garments that do not cling directly to the body (generally the abdomen, the lumbar region of the back, and particularly the region under the armpits), thus preventing its escape.

In other known cases, for example in U.S. Pat. No. 4,451,934 for a garment to be used under a non-porous outergarment, such as personal body armor for military personnel, workers exposed to high temperatures, firemen, which does not convey the water vapor to the environment, channels have been provided inside the garment, which prevents the contact of the outergarment with the wearer and in which the air and vapor can circulate and are conveyed upward by convection and then conveyed into the atmosphere.

The channels are open inward and at the ends in order to be able to receive the vapor produced by perspiration by the body and expel it, but in any case they do not prevent the penetration of liquids (water or other dangerous chemicals) from the outside toward the inside through the open ends, exposing the wearer of the garment to significant risks and discomfort.

In any case, this is still an undergarment which must always be used in combination with an outergarment, for which it reduces the problems arising from its non-porous nature.

SUMMARY OF THE INVENTION

The aim of the present invention is to provide a vapor-permeable garment, to be worn in order to improve the comfort of the human body, which solves the drawbacks noted above in known types.

In relation to this aim, an important object of the present invention is to provide a garment to be worn which ensures adequate air change inside the protective covering (ventilation) that surrounds the body without however venting the warmth required for protection against the cold.

Another object is to obtain a garment which while allowing the venting of the water vapor produced by perspiration, prevents any infiltration of water from outside, thus ensuring complete waterproofness of the garment to be worn.

Another important object of the present invention is to provide a breathable garment which allows in every respect the natural thermoregulation of the human body.

These and other objects which will become better apparent hereinafter are achieved by a garment, characterized in that it comprises a protective outer covering with an internal layer which affects at least part of the extension of said outer covering and internally forms an interspace, said internal layer having, at least at the regions of the human body affected by said garment where sweat forms more abundantly, holes for access to said interspace for the perspiration vapor, said internal layer and said outer covering having, in the upper regions of the garment, holes for venting the vapor channeled by "stack effect" inside said interspace, combined with means for keeping out water, impurities or other matter.

BRIEF DESCRIPTION OF THE DRAWINGS

Further characteristics and advantages of the present invention will become better apparent from the following description of some preferred embodiments, illustrated only by way of non-limitative example in the accompanying drawings, wherein.

DESCRIPTION OF THE PREFERRED EMBODIMENTS

Figures 1, 2:
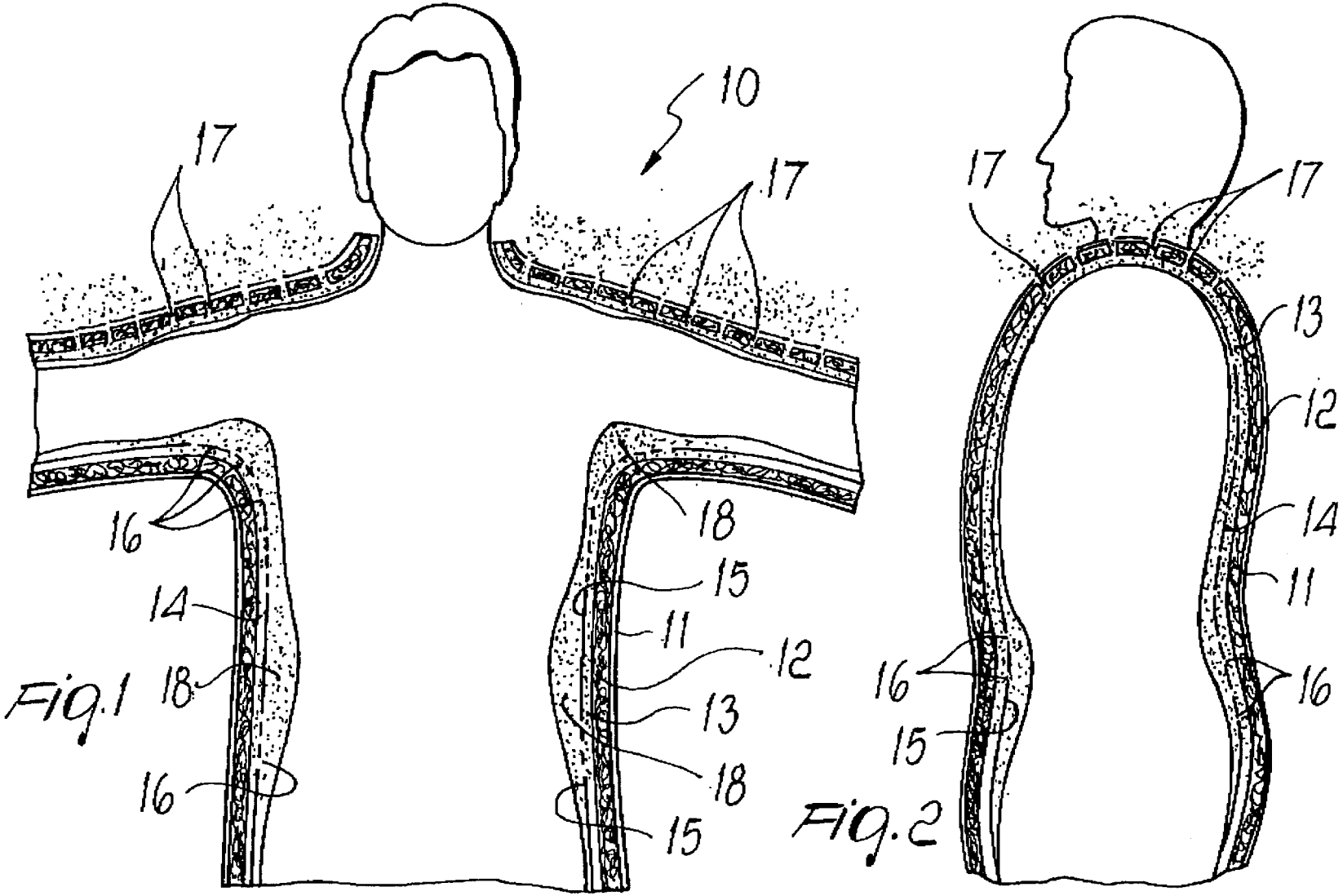
FIG. 1 is a sectional view, taken along a transverse plane, of a heavy jacket executed according to the present invention.
FIG. 2 is a sectional view, taken along another transverse plane, of the garment of FIG. 1.

With particular reference to the above FIGS. 1, 2, 3, 4, 5 and 6, a garment to be worn in order to improve human body comfort, according to the present invention, is constituted in this case by a heavy jacket 10.

Said heavy jacket 10 has an outer covering 11 having a protective function and can be conveniently made of fabric or of another material having suitable characteristics.

Said outer covering 11 can further be coupled to a per se known vapor-permeable membrane which is impermeable to water or, in other embodiments, to other materials.

In this particular embodiment, a layer of padding 12 of the per se known type is associated with the inner part of said covering 11.

Preferably, said padding layer 12 is composed of hydrophilic materials such as cotton wool, wool, felt and/or other similar materials.

In this manner, air is conveniently retained between the fibers of said padding layer 12 and thus ensures effective insulation from outside and retains the warmth around the human body.

The fibers that constitute said padding layer 12 are further capable of absorbing perspiration.

Said heavy jacket 10 is provided with an inner layer 13 whose structure is described in greater detail hereinafter.

Said layer structurally forms, inside it, an interspace, schematically designated by the reference numeral 14, in which water vapor can circulate, as described in detail hereinafter.

Said inner layer 13 is associated with the inner part of said padding layer 12 and is covered by a lining 15 of the per se known type.

Said lining is preferably of the type which is highly permeable to water vapor, so as to allow perspiration produced by the human body to pass.

At certain particular regions, in this case under the armpits and proximate to the hips, there are intake holes 16 formed in said lining 15 and in said internal layer 13, so as to allow the free access of water vapor to the interspace 14.

At the region of the heavy jacket 10 that covers the shoulders there are holes 17 formed in said outer covering 11, in the underlying padding layer 12 and partially in said internal layer 13 so as to be connected to said interspace 14.

Figure 5:
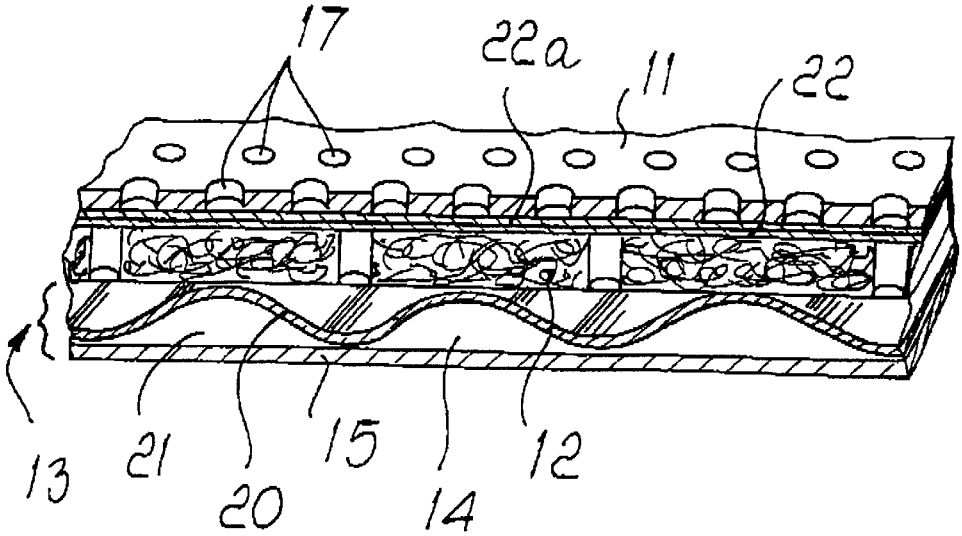
FIG. 5 is a perspective view of a detail of the upper part of the heavy jacket of FIG. 1.

With particular reference to FIG. 5, in the region in which said holes 17 are provided, below said protective outer covering 11 there is a membrane 22 which is impermeable to water (for which it therefore constitutes a retention means) but is breathable and therefore allows the outward venting of the water vapor.

In this manner, the water that arrives from outside, for example rain, cannot penetrate, while the water vapor can easily escape and ensure the natural thermoregulation of the human body.

Membranes which are permeable not only to vapor but also to air and are impermeable to water are also commercially available and can be used in this case, in which it is necessary to vent the vapor through the holes 17 and prevent water, dust and impurities from penetrating inside the garment.

These membranes also ensure a ventilation effect (air change) thanks to their permeability to air.

The membrane 22 must be appropriately combined with a protective layer 22*a* which is directed outward and/or inward, is made for example of fabric or non-woven fabric and is suitable to protect it from deterioration or possible contact with blunt objects which can spoil it.

A portion of membrane 22 can of course affect multiple holes 17, if they are clustered and, for example, provided in an insert, not shown, which is applied to the garment 10 so as to replace part of the covering 11.

The heavy jacket 10 can also be used during the warm season, for example in order to shelter oneself from a sudden storm, from the wind and/or rain or during sports activity simply by removing the padding layer.

Once this has been done, the heavy jacket 10 is in fact capable of expelling the perspiration that forms inside it and accordingly allows the natural regulation of the body, lowering its temperature.

The human body heats the air, schematically designated by the reference numeral 18, that is present between the outer surface of the layers inside the heavy jacket 10 and the lining 15 thereof.

As the insulating effect of the layer of padding 12 and most of all of the outer covering 11, which is quite often a waterproof material, progresses, the internal air 18 warms up and becomes damp due to perspiration.

Accordingly, the damp air 18 tends to expand naturally due to its heat and thus easily penetrates through said intake holes 16 until it reaches the interspace 14 formed in the internal layer 13.

Figure 3:
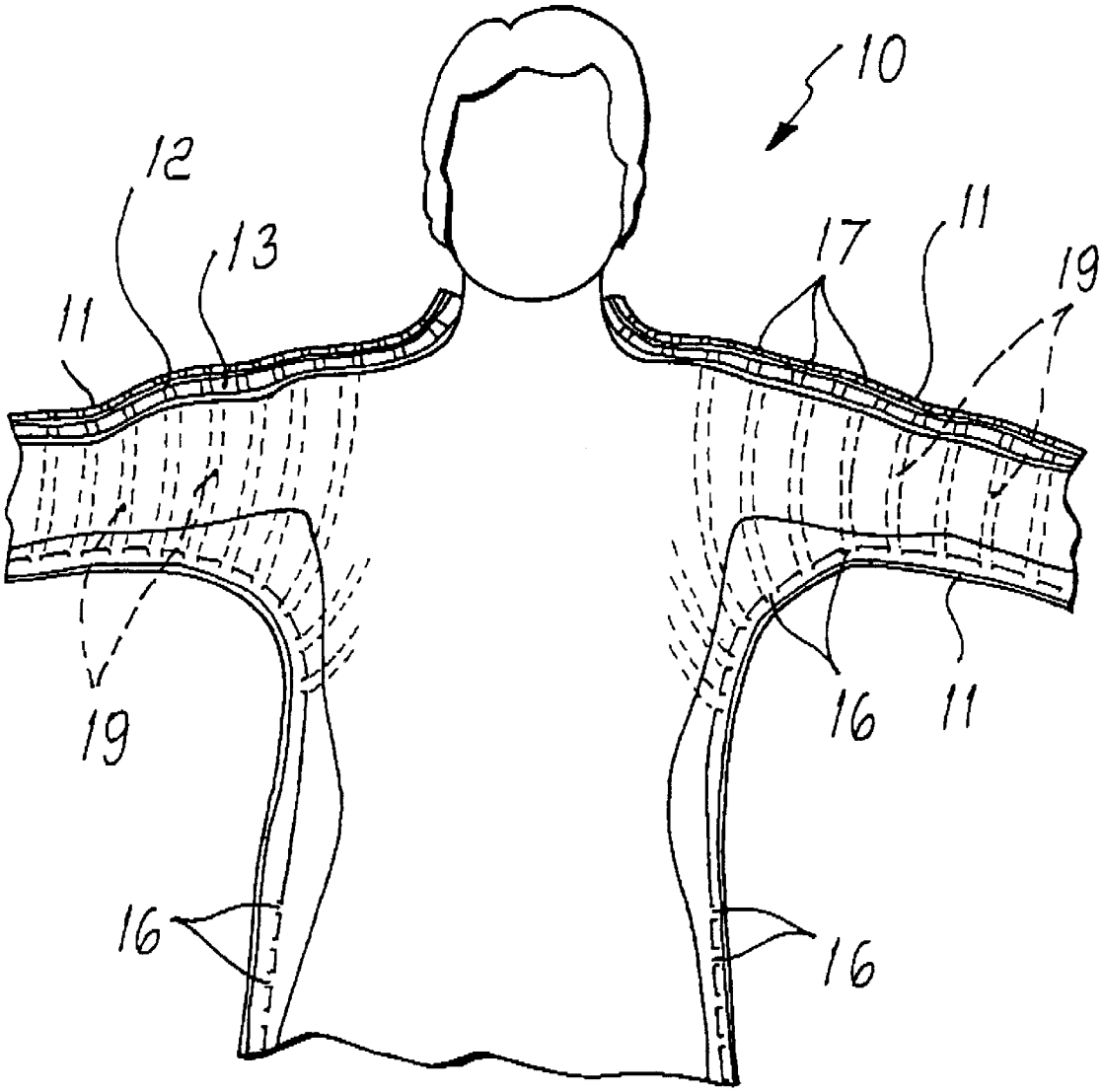
FIG. 3 is a schematic front view of the heavy jacket of FIG. 1.
Figure 4:
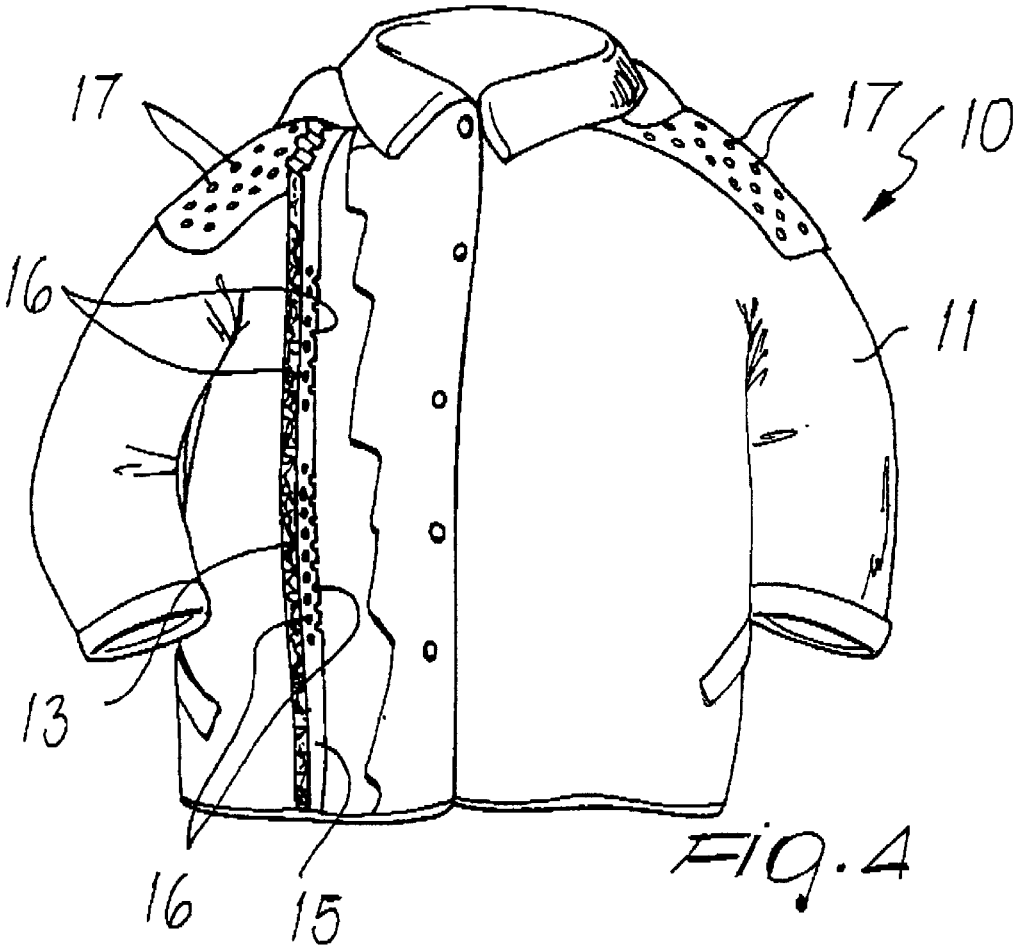
FIG. 4 is a perspective view of the heavy jacket of the preceding figures.

At this point, due to the ability of the damp air 18 to always move upward, it rises along said interspace 14, traveling along the channels schematically designated by the reference numeral 19 in FIG. 3, until it arrives at the holes 17 arranged on the shoulders and is vented externally through the membrane 22.

The membrane 22 instead prevents water or other matter from penetrating into the interspace 14.

Figure 6:
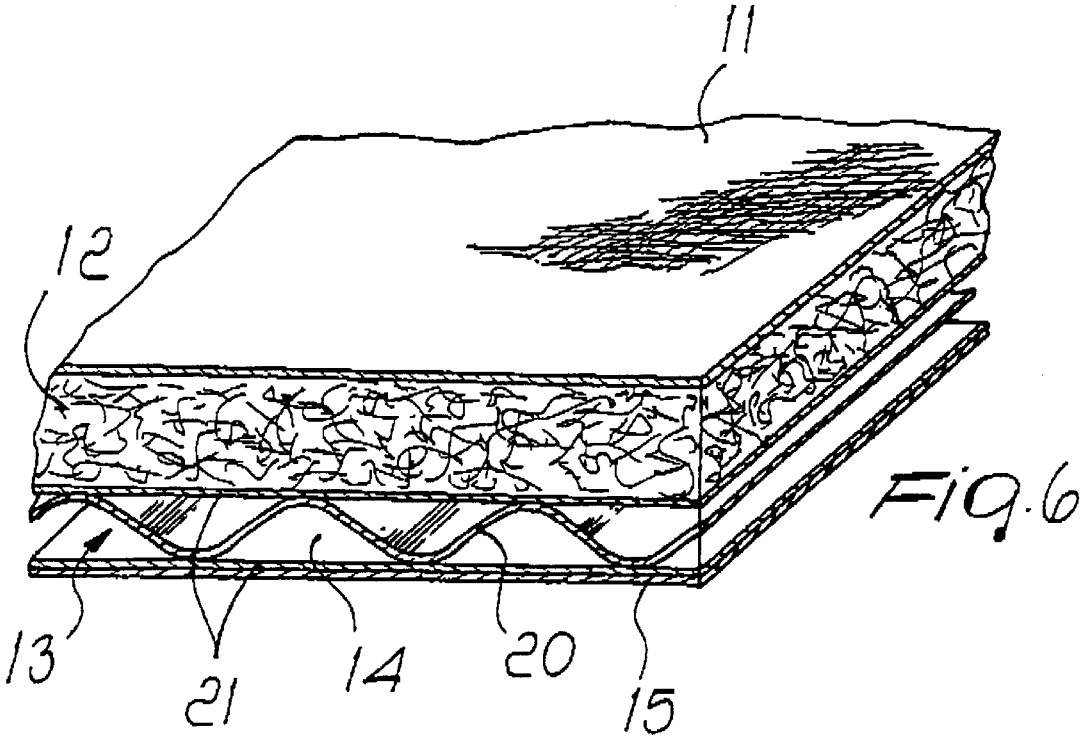
FIG. 6 is a sectional perspective view of a part of the garment shown in the above figures.

With particular reference to FIG. 6, said internal layer 13 is obtained, in this embodiment, by interposing a sheet of rigid undulated fabric 20 between two flat and parallel sheets 21, so as to form, inside it, said interspace 14 which in this case is constituted by a plurality of ducts through which water vapor can flow easily.

It is in fact sufficient to take care to associate said internal layer 13 with the layer of padding 12 so that said ducts that constitute the interspace 14 run predominantly along the vertical axis.

Figure 7:
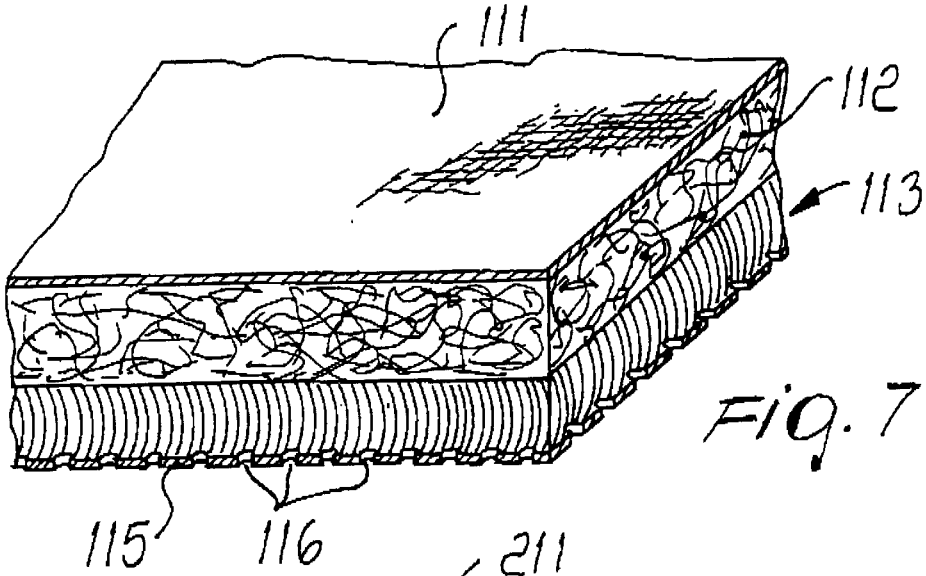
FIG. 7 is a perspective view of a second embodiment of the part of FIG. 6.

With particular reference to FIG. 7, a second embodiment is obtained by using an internal layer 113 which is made of a pile cloth-like material, which in this case has a considerable thickness but can be thin in equivalent solutions; said internal layer is coupled to an outer covering 111 and to a padding layer 112 which are fully equivalent to the ones described above.

In this case also, the presence of the lining, now designated by the reference numeral 115, is clearly noticeable; said lining has holes 116 to allow water vapor to access the inside of the interspace 114 formed between the fibers of the pile cloth-like material.

Figure 8:
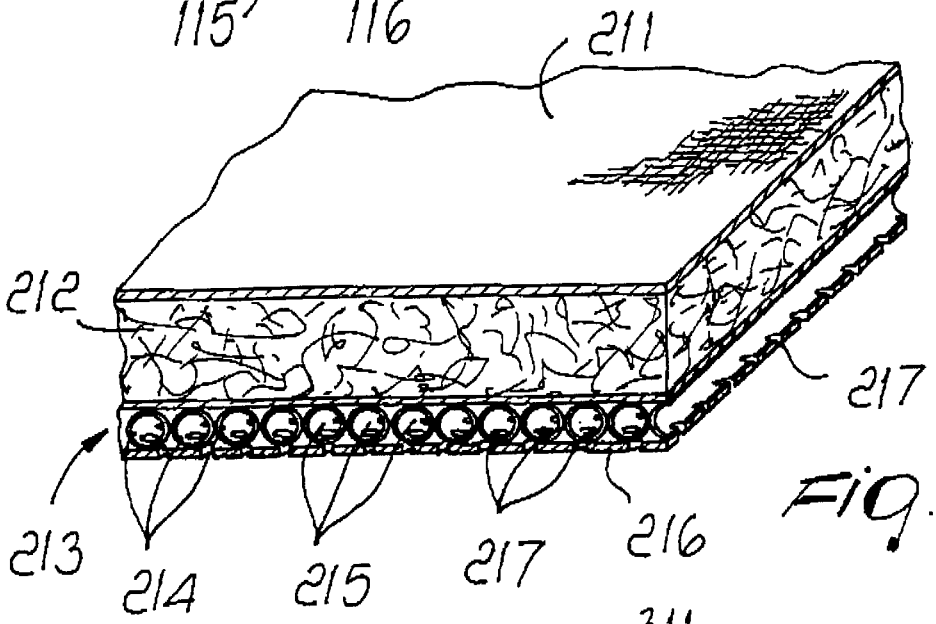
FIG. 8 is a perspective view of a third embodiment of the part of FIG. 6.

With reference to FIG. 8, a third embodiment is obtained by coupling to an outer covering 211 and to a padding layer 212 which are per se known, an internal layer 213 which is constituted by a plurality of small tubes 214 arranged side by side, so that the interspace 215 is formed by the set of passages provided inside each one of said tubes 214.

In this embodiment also, said internal layer 213 is associated with the padding layer 212 so that said tubes 214 extend vertically.

The presence of the lining, now designated by the reference numeral 216, and of the access holes 217 formed in said lining 216 and in said tubes 214, is clearly visible in this case also.

Only in this way can the water vapor in fact enter through said access holes 217 and, by rising along the tubes 214, arrive at the top part of the garment.

Figure 9:
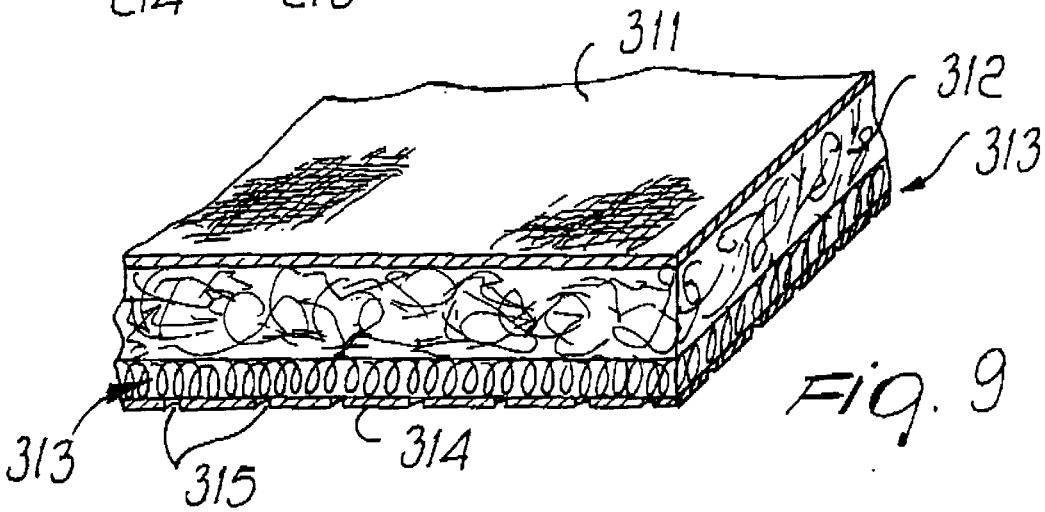
FIG. 9 is a perspective view of a fourth embodiment of the part of FIG. 6.

With particular reference to FIG. 9, a fourth embodiment is obtained by coupling to an outer covering 311 and to a layer of padding 312 which are per se known, an internal layer 313 constituted by a layer of cotton wool inside which the water vapor can circulate.

In this case also, the garment is completed by the lining 314, in which the vapor access holes 315 are formed.

Figure 10:
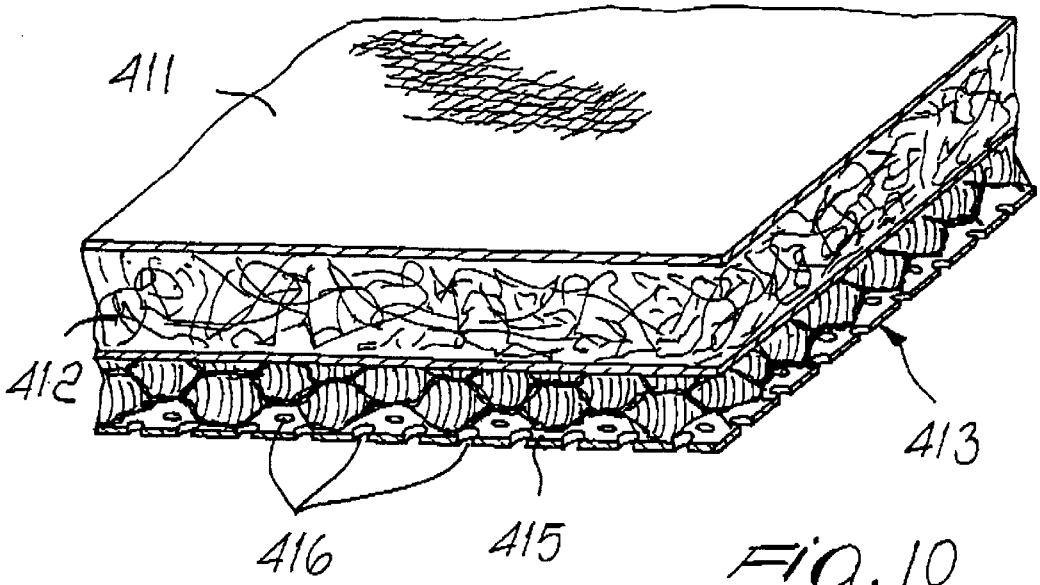
FIG. 10 is a perspective view of a fifth embodiment of the part of FIG. 6.

With particular reference to FIG. 10, a fifth embodiment is obtained by coupling to an outer covering, now designated by the reference numeral 411, and to a padding 412 layer, which are per se known, an internal layer 413 formed with a three-dimensional mesh, in this case made of a material known commercially by the trademark nylon, which is covered by a lining 415 in which access holes 416 for the water vapor are formed.

Figure 11:
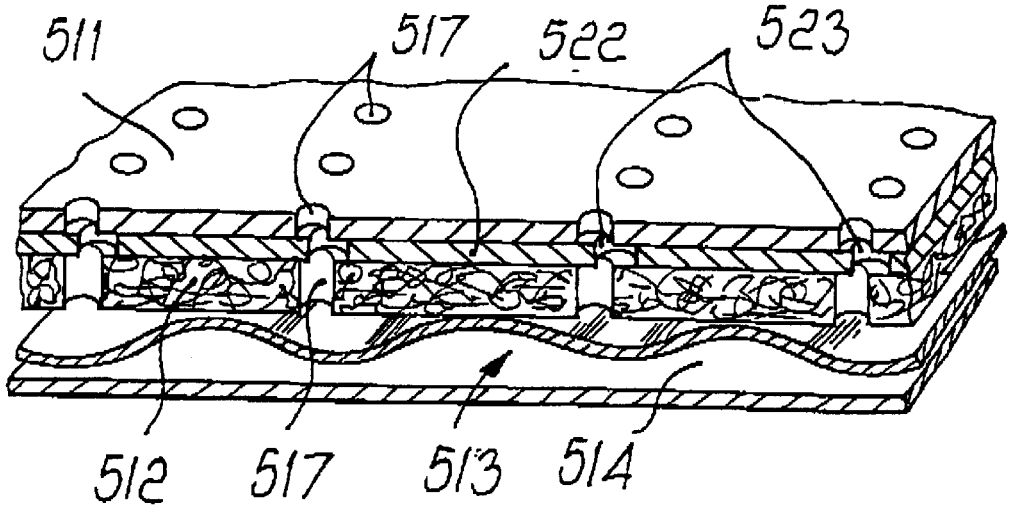
FIG. 11 is a perspective view of a second embodiment of the detail of FIG. 5.

With reference to FIG. 11, in a second embodiment related to the structure of the heavy jacket 10, at the top region in which the water vapor venting holes, now designated by the reference numeral 517, are formed, instead of the membrane 22 between said protective outer covering 511 and the underlying layer of padding, now designated by the reference numeral 512, there is another retention means constituted by a sliding flat element 522 in which through holes 523 are formed.

In particular, said through holes 523 are, in the operating configuration, aligned with said venting holes 517, so that the interspace 514 formed in the internal layer 513 is directly connected to the outside.

In this case, said flat element 522 can slide with respect to the outer covering 511 and to the padding layer 512 by way of a traction which is applied, in this case, directly by the user, to an extension which protrudes monolithically from the flat element 522 and partially exits from the outer covering 511 (not shown for the sake of simplicity in said figure) so as to be directly available to the action of the user.

In this manner, in the presence of unfavorable conditions, particularly rain, the user can slide said flat element 522 so that the through holes 523 formed therein are not aligned with respect to said exit holes 517, thus preventing any water infiltration.

When allowed by the conditions, it is instead sufficient to allow the through holes 523 formed in the flat element 522 to align themselves with the exit holes 517, so that the water vapor can exit and thus allow normal body thermoregulation.

Figure 12:
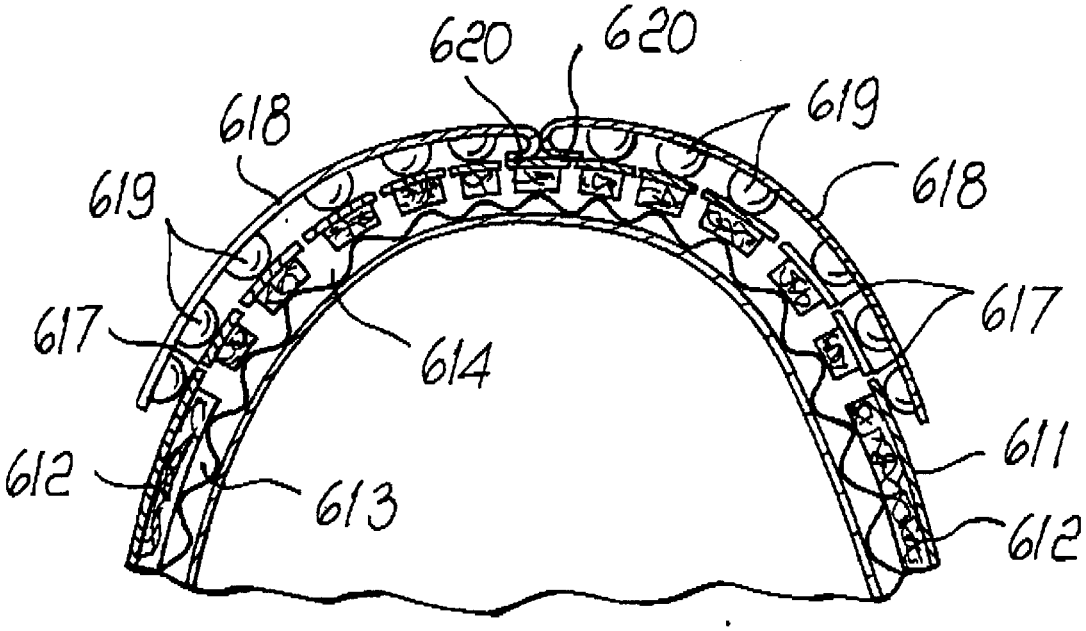
FIG. 12 is a sectional view, taken along a transverse plane, of a third embodiment of the detail of FIG. 5.

With reference to FIG. 12, in a third embodiment the breathable garment has, at the region where said venting holes 617 are formed, in the outer covering 611 and in the underlying padding layer 612, water retention means which are constituted, in this case, by flaps 618 which are applied, as specified hereinafter, so as to cover all the region of the outer covering 611 in which the venting holes 617 are formed.

In this case, said flaps 618 are in fact applied on the shoulders and have, on the side directed toward the outer covering 611, a plurality of ridges 619 which keep them adequately raised from said outer covering 611, so that in practice they are not fully rested thereon and on the venting holes 617.

In this manner, the water vapor that arrives from the interspace 614 formed in the internal layer 613 can escape by passing through said holes 617 by way of the ridges 618 which keep the flaps 618 raised.

At the same time, however, rain cannot enter the garment because it glides off, remaining outside the flaps 618.

In this embodiment, said flaps 618 are fixed to the outer covering 611 by means of stitched seams 620, but in equivalent embodiments it is possible to use other fixing means, for example resorting to hook and loop strips of a material known commercially by the trademark Velcro.

Figure 13:
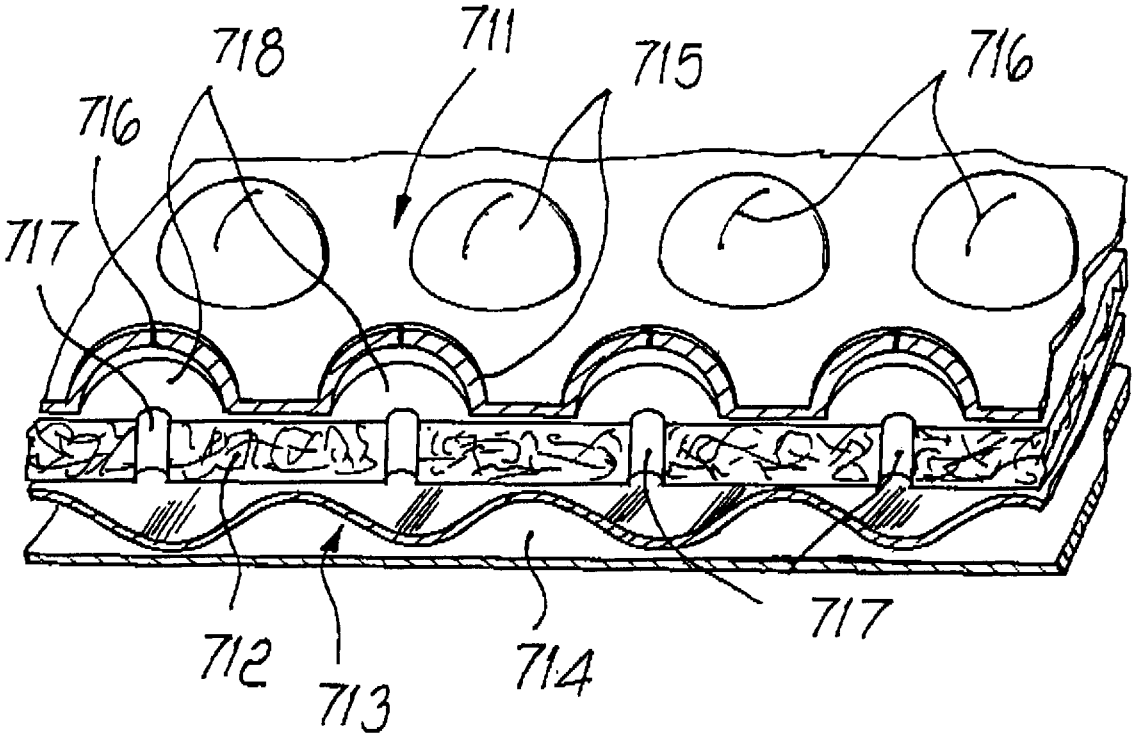
FIG. 13 is a perspective view of a fourth embodiment of the detail of FIG. 5.

With particular reference to FIG. 13, a fourth embodiment is constituted, in this case for the water retention means, at least in the water vapor venting regions, by an outer covering 711 whose structure is constituted by a plurality of small domes 715 and which is commercially known by the trade-name Stomatex.

A layer of padding 712 and an internal layer 713 which forms an interspace 714 are associated below said outer covering, as usual.

In this case, a slit 716 is formed in the outer covering 711 at the top of each one of said small domes 715 and is aligned with a corresponding venting hole 717 formed in the padding layer 712.

In this manner, the air-filled chambers 718 formed between each one of said small domes 715 and the underlying layer of padding 712 are affected by the passage of water vapor which, arriving from the interspace 714, passes through said venting holes 717 and the overlying slits 716 and is expelled outside.

The described solution is certainly highly satisfactory, since the higher internal pressure that can be measured in each one of said air-filled chambers 718 allows easy escape of the water vapor, at the same time preventing any infiltration of water.

This constructive structure can be preferably adopted in body-clinging garments meant for people performing physical activities, for example cycling, so that the very movement of the user produces, by compression, a higher pressure inside each air-filled chamber 718.

Figure 14:
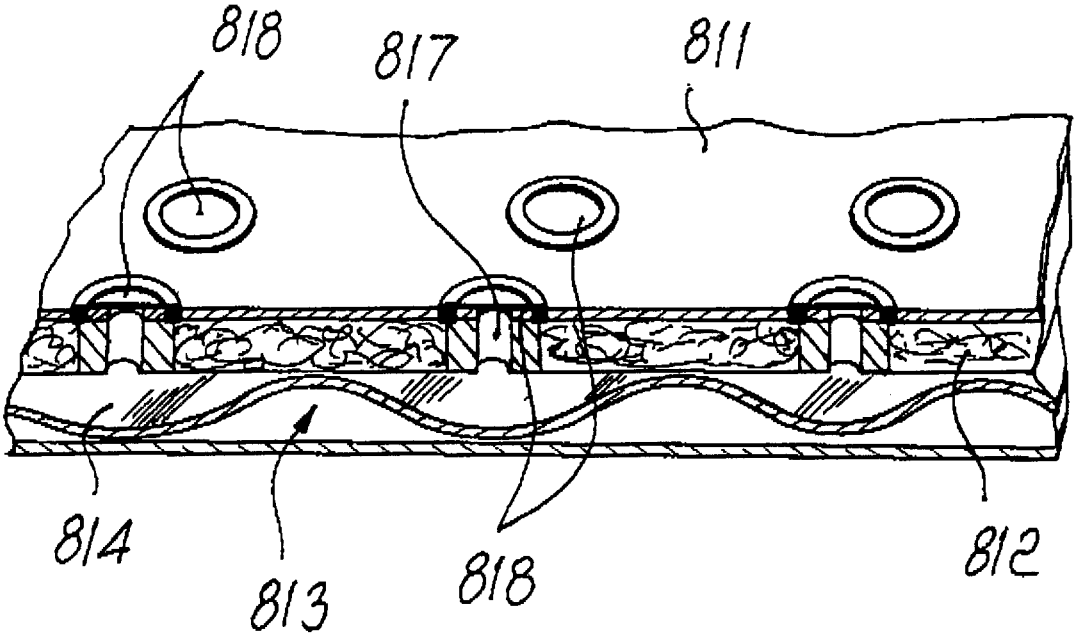
FIG. 14 is a perspective view of a fifth embodiment of the detail of FIG. 5.

With particular reference to FIG. 14, a fifth embodiment is obtained, in this case, by providing each one of the venting holes 817 formed in the outer covering 811 and in the padding layer 812 with a water retention means constituted by a one-way valve 818.

Said valve comprises a movable disk, of the per se known type, which is fixed to the outer covering 811 so as to cover each one of said venting holes 817.

Said disk of the one-way valve 818 rises every time the pressure in the underlying region, i.e., in the holes 817, is higher than the outside pressure, thus allowing the escape of the water vapor.

Evidently, in this embodiment the water vapor that arrives from the interspace 814 formed in the internal layer 813 is able to escape without the movable disk of each valve 818 allowing any water that is present outside to enter the garment.

Figure 15:
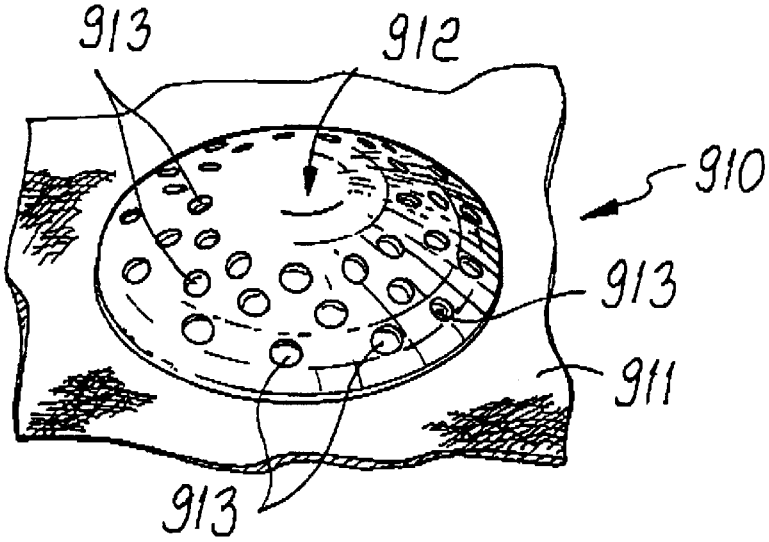
FIG. 15 is a perspective view of a sixth embodiment of the detail of FIG. 5.
Figure 16:
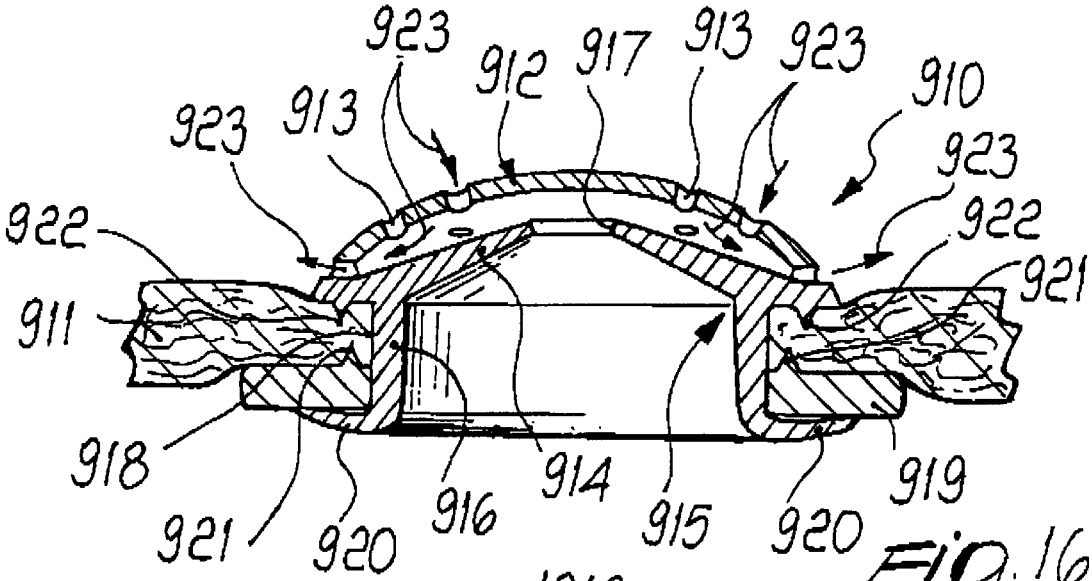
FIG. 16 is a sectional view, taken along a transverse plane, of the detail of FIG. 15.

With reference to the above cited FIGS. 15 and 16, said figures show another embodiment of the water retention means, generally designated by the reference numeral 910, which in this case are applied to a fabric 911 of a garment such as the ones cited above, preferably of the waterproof type, not shown in the above figures for the sake of simplicity.

Said retention means 910 comprise a protective dome 912 in which holes 913 are formed being uniformly distributed in regions other than the central one.

Said dome 912 is fixed above the head 914, which in this case is diskshaped, of a mushroom-like element 915 which is provided with a tubular stem 916.

In other cases, the head 914 can also have a polygonal, oval, elliptical, or other shape.

The dome 912 is raised from said disk-like head 914 except at the fixing region.

Said disk-like head 914 constitutes a ventilation element which has a frustum-shaped contour and therefore slopes toward its peripheral region and has, at the top region, a central opening 917 which in this case is circular.

Said mushroom-shaped element 915 is suitable to be associated with the fabric 911 at one of the holes 918 that connect the interspace cited in the preceding cases to the outside in the top part of the garment.

Said stem 916, after passing in succession through said opening 918 and a fixing washer 919 of the per se known type, in fact has an end portion 920 which is conveniently folded back against said washer 919, so that the fabric 911 that surrounds the opening 918 is compressed between the disk-like head 914 and the washer 919.

In this embodiment, said washer 919 has, at the part that is suitable to be pressed against the fabric 911, points 921 which act as rotation-preventing elements.

Furthermore, points 922, fully equivalent to said points 921, for preventing rotation protrude also from said disk-like head 914 of the mushroom-shaped element 915, on the side designed to be placed in contact with the fabric 911.

In summary, the described retention means 910 allow the passage of water vapor, which can easily escape from the region below the fabric 911, passing through the hole 917 formed in the disk-like head 914 of the mushroom-shaped element 915 and, from there, through the holes 913 formed in the protective dome 912.

Likewise, the air from outside can easily enter the region below the fabric 911, so as to ensure optimum thermal ventilation of the human body.

However, in case of rain the water drops that are able to penetrate through the holes 913 of the protective dome 912 cannot pass beyond the opening 917 because the holes 913 are not aligned with said opening and indeed, by virtue of the frustum-like contour of the disk-like head 914, the drops glide toward the outer region of the head until they exit through appropriately provided holes 913 arranged along the perimeter of the protective dome 912, as shown schematically by the arrows 923.

Figure 17:
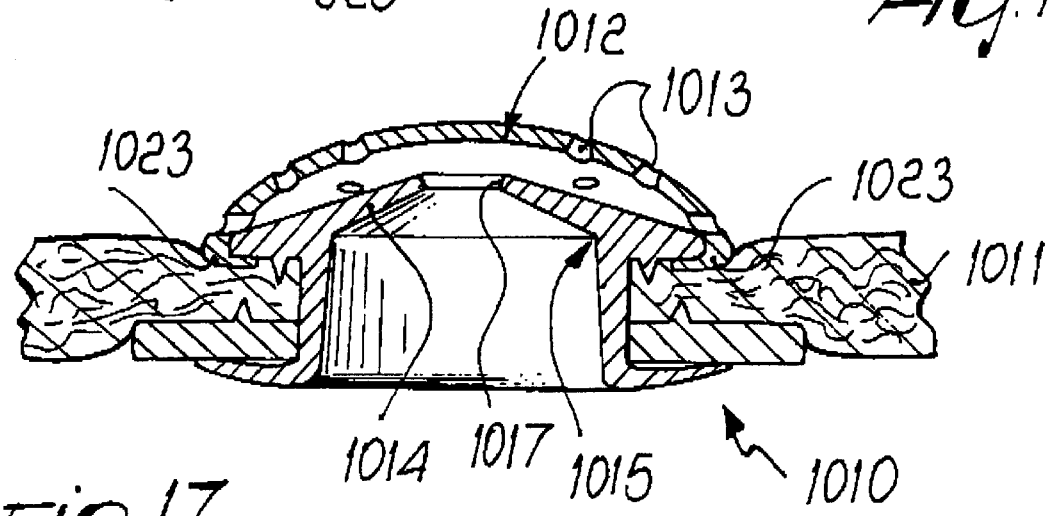
FIG. 17 is a sectional view, taken along a transverse plane, of still another embodiment of the detail of FIG. 15.

With particular reference to FIG. 17, another embodiment of a retention means is designated in this case by the reference numeral 1010 and comprises a protective dome 1012 which is fully equivalent to the preceding one and in which holes 1013 are formed at the perimetric region.

In this case, said dome 1012 has, along its entire perimetric extension, a protrusion 1023 which, once arranged above the disk-like head 1014 of a mushroom-shaped ventilation element 1015, is suitable to be folded around the corresponding perimetric edge of the head 1014.

In this embodiment also, said head 1014 forms, in the top region, a central opening 1017 which is not aligned with the holes 1013 of the dome 1012.

In summary, said retention means 1010, as described for the preceding one 910, ensures the passage of water vapor, which can exit from the region below the fabric 1011, passing through the opening 1017 and through the holes 1013 formed in the dome 1012.

Likewise, raindrops are unable to penetrate; instead, by gliding on the disk-like head 1014, they are conveyed toward the outer region of said device 1010.

Figure 18:
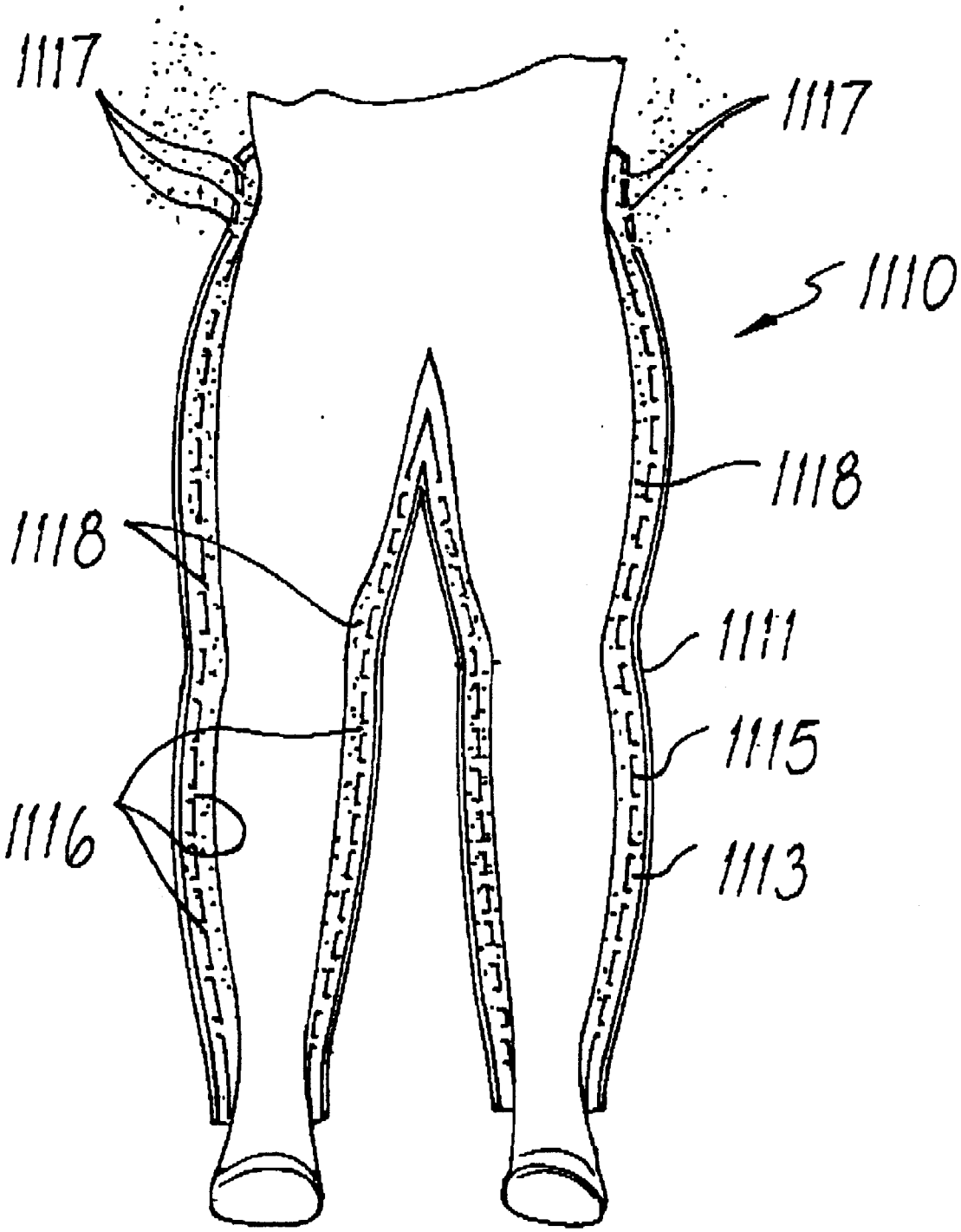
FIG. 18 is a schematic front view of a pair of trousers obtained according to the present invention.

With reference to FIG. 18, a pair of breathable trousers, designated by the reference numeral 1110 and obtained according to the present invention, are fully equivalent to the above described heavy jacket 10.

Said trousers 1110 are in fact constituted by an outer covering 1111 which has a protective function and with which a layer of padding of the per se known type, not shown in the figure for the sake of simplicity, is associated at the inner part.

Said trousers 1110 conveniently have an internal layer 1113, whose structure is fully equivalent to one of the structures presented above in FIGS. 6, 7, 8, 9 and 10, which internally forms an interspace in which water vapor can circulate.

Said internal layer 1113 is covered by a lining 1115 which is permeable to water vapor and in which intake holes 1116 are formed at least at the regions of the human body that are richest in sweat glands; the vapor accesses the inside of the interspace through said holes 1116.

At the part that surrounds the waist of the trousers 1110 there are water vapor venting holes 1117 which are formed in said outer covering 1111, in the underlying layer of padding and, if necessary, in said internal layer 1113 so as to be connected to said interspace.

The holes 1117 are combined with a membrane 1122 which is fully equivalent to the cited one 22 and is coupled to an external protective layer 122*a*.

As an alternative, it is possible to provide one of the retention means described earlier.

The air, schematically designated by the reference numeral 1118, that is present between the legs of the user and the lining 1115 of the trousers 11 10 warms up, so that as the insulating effect of the layer of padding and most of all of the outer covering 1111 progresses, it becomes damp due to perspiration.

Accordingly, said damp air 1118 tends to expand naturally due to the heat and thus easily enters through said intake holes 1116 until it reaches the interspace formed in the internal layer 1113.

At this point, due to the ability of the damp air 1118 to flow upward, it rises along the interspace until it arrives at the venting holes 1117 arranged in the belt region and is vented outside through the membrane 1122.

In practice it has been found that the present invention has effectively achieved the aim and all the intended objects.

In particular, the present invention is susceptible of numerous modifications and variations, all of which are within the scope of the same inventive concept.

For example, the lining might be replaced with a mesh-like structure or be omitted from the garment.

In yet another embodiment, the padding layer is constituted by fibers which include, either externally or internally (if the fibers are hollow) and at least partially, a material per se known as "phase change material", in the manner disclosed for example in patent application WO 98/123066 of Sep. 18, 1997 and in European patent no. 311642.

In this embodiment, said phase change materials in fact allow to reduce the thickness of the thermal insulation thanks to their special ability to retain and accumulate heat.

The heat generated by the body produces perspiration, but while said perspiration is expelled by evaporation from the breathable garment, the heat is absorbed by the phase change materials (by radiation and/or induction).

When the body expels perspiration and ceases producing heat, said materials in fact act so as to vent the heat accumulated earlier and make it "available" to the body so as to prevent any sudden chill.

It is evident that the structures of the described breathable garments can easily be extended to all garments, including caps, hats and helmets.

A considerable advantage that must be noted once more has been achieved by virtue of the present invention in that a garment has been perfected which ensures adequate air change inside the protective covering that surrounds the body without however venting the warmth required to protect it from the cold.

Another important advantage has been achieved in that a garment has been obtained which, while allowing the water vapor produced by perspiration to escape, prevents infiltrations of water from outside, thus ensuring waterproofness.

Attention is also drawn to another important advantage, since a breathable garment has been perfected which allows in every respect the natural thermoregulation of the human body also by virtue of the ventilation effect allowed by the continuous and substantial air change inside it.

The garments provided according to the present invention can in fact be worn without problems in summer (for example by removing the layer of padding) when high temperatures cause increased perspiration production.

Said perspiration is expelled very effectively from the described breathable garments, thus allowing the human body to regulate its own temperature in a fully natural way.

All the details may be replaced with other technically equivalent elements.

The materials used, so long as they are compatible with the contingent use, as well as the dimensions, may be any according to requirements.

The disclosures in Italian Patent Application No. PD99A000149 from which this application claims priority are incorporated herein by reference.

What is claimed is:

1. A breathable garment, comprising a protective outer covering with an internal layer which extends over at least part of the extension of said outer covering and internally forms an interspace, said internal layer having, at least at regions of a human body covered by said breathable garment where sweat forms more abundantly, holes for access to said interspace for perspiration vapor, said internal layer and said outer covering having, in top regions of the garment, holes for venting the vapor channeled by a stack effect inside said interspace, combined with water retention means for keeping out water, impurities or other matter.

2. The breathable garment according to claim 1, wherein said internal layer is obtained by interposing a rigid undulated sheet between two flat and parallel sheets.

3. The breathable garment according to claim 1, wherein said internal layer is made of pile cloth-like material.

4. The breathable garment according to claim 1, wherein said internal layer is constituted by a plurality of tubes arranged side by side.

5. The breathable garment according to claim 1, wherein said internal layer is constituted by cotton wool.

6. The breathable garment according to claim 1, wherein said internal layer is a three-dimensional mesh.

7. The breathable garment according to claim 6, wherein said three-dimensional mesh is made of a material known commercially by the trademark Nylon.

8. The breathable garment of claim 1, wherein water retention means are constituted by a membrane which is permeable to vapor and/or permeable to air and impermeable to water, and is arranged at the top regions where said vapor exit holes are formed, said membrane being interposed between said outer covering and said internal layer.

9. The breathable garment according to claim 8, wherein said membrane is coupled to an external and/or internal protective layer.

10. The breathable garment of claim 8, wherein, in the top regions where said vapor exit holes are formed, between said outer covering and said internal layer, said retention means are constituted by a flat element which is slideable from an active position to a blocking position, through holes being formed therein, said holes being aligned with the vapor exit holes when the flat element is in the active position.

11. The breathable garment according to claim 10, wherein said flat element comprises an extension which is directly available to action of a user in order to slide it from said active position to said blocking position and vice versa.

12. The breathable garment according to claim 8, wherein in the top regions of the outer covering on which said vapor exit holes are formed, transmission means are constituted by flaps which are applied and are adapted to cover the holes, said flaps having, on a side directed toward the outer covering, ridges which are adapted to keep them partially raised and allow the vapor to exit from the holes.

13. The breathable garment according to claim 12, wherein said flaps are associated with said outer covering by way of fixing means.

14. The breathable garment according to claim 13, wherein said fixing means are constituted by stitched seams.

15. The breathable garment according claim 14, wherein said fixing means are constituted by hook and loop fastner strips of a material of the type known commercially by the trademark Velcro.

16. The breathable garment according to claim 1, wherein, in the top regions in which said vapor exit holes are formed, said water retention means are formed by an outer covering which is constituted by a layer, shaped so as to form a plurality of small domes, a slit being formed at the top of each one of said small domes and being aligned with a corresponding passage which is connected to said interspace.

17. The breathable garment according to claim 1, wherein said retention means are constituted by a one-way valve with which each one of said vapor exit holes is provided.

18. The breathable garment according to claim 1, wherein said retention means comprise:

a disk-like element provided with fixing means for fixing to fabric of the garment at a suitable opening, said disk-like element having, at a side to be arranged outward, a shape which slopes from a center thereof toward the peripheral region and a top opening, an external protective dome which is substantially raised from said disk-like element, is fixed perimetrically thereto and has at least one hole situated away from a central opening.

19. The breathable garment according to claim 18, wherein said disk-like element has a frustum-shaped contour which has at said central opening a circular contour.

20. The breathable garment according to claim 19, wherein said ventilation element is a head of a mushroom-shaped element which has a tubular stem adapted to pass through said opening of said fabric.

21. The breathable garment according to claim 20, wherein said fixing means for fixing to the fabric comprise said stem and a washer, said stem having an end portion from folding back against said washer so that the fabric that surrounds the opening is compressed between said disk-like head and said washer.

22. The breathable garment according to claim 21, wherein said washer has, at the part that is adapted to be pressed against the fabric, points which act as rotation-preventing elements.

23. The breathable garment according to claim 21, wherein rotation-preventing points protrude from said head of the mushroom-shaped element, on the side meant to be placed in contact with the fabric.

24. The breathable garment according to claim 18, wherein said protective dome has a plurality of holes which are uniformly distributed in regions other than the top one.

25. The breathable garment according to claim 18, wherein said protective dome is raised from said element except at the fixing position.

26. The breathable garment according to claim 18, wherein said protective dome has, along a perimetric extension thereof, a protrusion which, once arranged above said element, is foldable around the corresponding perimetric edge thereof.

27. The breathable garment according to claim 1, comprising a padding layer between said outer covering and said internal layer.

28. The breathable garment according to claim 27, wherein said padding layer is composed of hydrophilic materials such as cotton wool, wool, felt or other materials having similar characteristics.

29. The breathable garment according to claim 27, wherein said padding layer is constituted by fibers which include, either externally or internally, in the case of hollow fibers and at least partially, a material per se known as phase-change material.

30. The breathable garment according to claim 1, comprising a lining which covers said internal layer, said access holes for said interspace being formed in said lining.

31. The breathable garment according to claim 30, wherein said lining is permeable to water vapor.

32. The breathable garment according to claim 30, wherein said lining has a mesh-like structure.

33. The breathable garment according to claim 1, wherein said outer covering is coupled to a breathable and waterproof membrane or to another material.

34. Headgear, having a breathable structure according to claim 1.

35. A helmet, having a breathable structure according to claim 1.

* * * * *

UNITED STATES PATENT AND TRADEMARK OFFICE

CERTIFICATE OF CORRECTION

PATENT NO. : 6,263,511 B1
DATED : July 24, 2001
INVENTOR(S) : Mario Polegato Moretti It is certified that error appears in the above-identified patent and that said Letters Patent is hereby corrected as shown below:

Title page,
References Cited, please add the following references:

| | | |
|---|---|---|
| -- 3,706,102 | 10/19/72 | A. Grenier |
| 4,185,327 | 01/29/80 | H.J. Markve |
| 3,296,626 | 01/10/67 | S.W. Ludwikowski |
| 2,400,627 | 05/21/46 | M.A. Chavannes |
| 3,700,539 | 10/24/72 | J. Pufahl |
| 3,758,358 | 09/11/73 | M. Kuroda |
| 5,543,194 | 08/06/96 | M.F. Rudy |
| 3,801,420 | 04/02/74 | A. Anderson |
| 4,690,847 | 09/01/87 | B.D. Lassiter, et al. |
| 4,469,736 | 09/04/84 | W. Machholz |
| WO 99/34972 | 07/15/99 | WIPO |
| 865 582 | 02/02/53 | Germany |
| 426,273 | 04/01/35 | Great Britain |
| 103,884 | 02/15/17 | Great Britain |
| 2 270 829 | 03/30/94 | Great Britain |
| 2 525 876 | 11/04/83 | France |
| 2 516 202 | 05/13/83 | France |
| 1 452 795 | 10/13/76 | Great Britain |
| 2.203.273 | 05/10/74 | France |
| 987,112 | 03/24/65 | Great Britain |
| 1,094,893 | 12/13/67 | Great Britain -- |

Signed and Sealed this

Tenth Day of September, 2002

*Attest:*

*Attesting Officer*

JAMES E. ROGAN
*Director of the United States Patent and Trademark Office*